United States Patent [19]

Coit

[11] 4,166,497

[45] Sep. 4, 1979

[54] APPARATUS FOR INCREASING EFFECTIVE SCAVENGING VENT STEAM WITHIN A HEAT EXCHANGER WHICH CONDENSES VAPOR INSIDE LONG TUBES

[75] Inventor: Roland L. Coit, Swarthmore, Pa.

[73] Assignee: Westinghouse Electric Corp., Pittsburgh, Pa.

[21] Appl. No.: 827,765

[22] Filed: Aug. 25, 1977

Related U.S. Application Data

[63] Continuation of Ser. No. 650,836, Jan. 21, 1976, abandoned.

[51] Int. Cl.[2] ..... F28F 13/04; F28B 9/08

[52] U.S. Cl. ..... 165/111; 165/158

[58] Field of Search ..... 122/382, 483, 488; 165/173-176, 158-161, 110-111

[56] References Cited

U.S. PATENT DOCUMENTS

| | | | |
|---|---|---|---|
| 2,098,671 | 11/1937 | Paget | 165/161 X |
| 3,593,500 | 7/1971 | Ritland | 55/319 |
| 3,759,319 | 9/1973 | Ritland | 165/158 |

FOREIGN PATENT DOCUMENTS

| | | | |
|---|---|---|---|
| 10770 | 4/1908 | Denmark | 165/158 |
| 2247691 | 9/1975 | France | 165/158 |

*Primary Examiner*—Samuel Scott
*Assistant Examiner*—Theophil W. Streule, Jr.
*Attorney, Agent, or Firm*—F. J. Baehr, Jr.

[57] ABSTRACT

A manifold is disposed in the inlet portion of a U-tube heat exchanger head to produce four passes, an outlet portion of the head forms a plenum chamber between the second and third pass to remove condensate from the steam and the manifold is vented to increase the effective scavenging of condensate from the tube side of the heat exchanger.

6 Claims, 4 Drawing Figures

APPARATUS FOR INCREASING EFFECTIVE SCAVENGING VENT STEAM WITHIN A HEAT EXCHANGER WHICH CONDENSES VAPOR INSIDE LONG TUBES

This is a continuation of application Ser. No. 650,836 filed Jan. 21, 1976 and now abandoned.

BACKGROUND OF THE INVENTION

This invention relates to heat exchangers and more particularly to a device for scavenging condensate from inside long tubes of a heat exchanger.

When there are a number of tubes condensing in parallel, variations in condensing produces different flow patterns in different tubes, which result in condensate build-up in certain tubes. After the condensate plugs the tubes, the flooded tubes purge themselves and the cycle begins again resulting in thermal shock and stresses, which in time cause failure adjacent the area where the tubes are welded to the tube sheet.

One solution to this problem is to vent a portion of the steam to a lower pressure receptacle, increasing the flow through the tubes and thereby scavenging the condensate which collects in the tubes, however, unless very large quantities of steam are vented, this method is ineffective in keeping all the tubes free from plugs of condensate. From a thermodynamic standpoint, the greater the quantity of vented steam, the lower the thermal efficiency of the system and therefoe, the more costly it is to operate. Ritland et al in U.S. Pat. No. 3,759,319, issued Sept. 18, 1973, and assigned to the same assignee, describes one solution to this problem and this invention describes still another solution.

SUMMARY OF THE INVENTION

In general, a heat exchanger for transferring heat from a first fluid, which changes state from a vapor to a liquid, to a second fluid, which increases in temperature, when made in accordance with this invention, comprises a shell, a tube sheet having a plurality of holes and a head cooperatively associated with the shell and tube sheet. A plurality of the tubes have at least one end disposed in the holes in the tube sheet and a dividing plate is disposed in the head to produce an inlet and outlet portion thereof. An inlet nozzle is disposed in fluid communicatin with the inlet portion of the head and a manifold is disposed within the inlet portion of the head. The manifold is so disposed in fluid communication with a plurality of the tubes to causes the first fluid to make four passes through the second fluid. The outlet portion of the head has a liquid drain nozzle disposed therein and is disposed to form a plenum chamber between the second and third passes, whereby liquid is separated from the first fluid prior to entering the third pass and a vent line in fluid communication with the manifold is disposed to vent vapor from the manifold.

BRIEF DESCRIPTION OF THE DRAWINGS

The objects and advantages of this invention will become more apparent from reading the following detailed description in connection with the accompanying drawings, in which.

DESCRIPTION OF THE PREFERRED EMBODIMENTS

Figure 1:
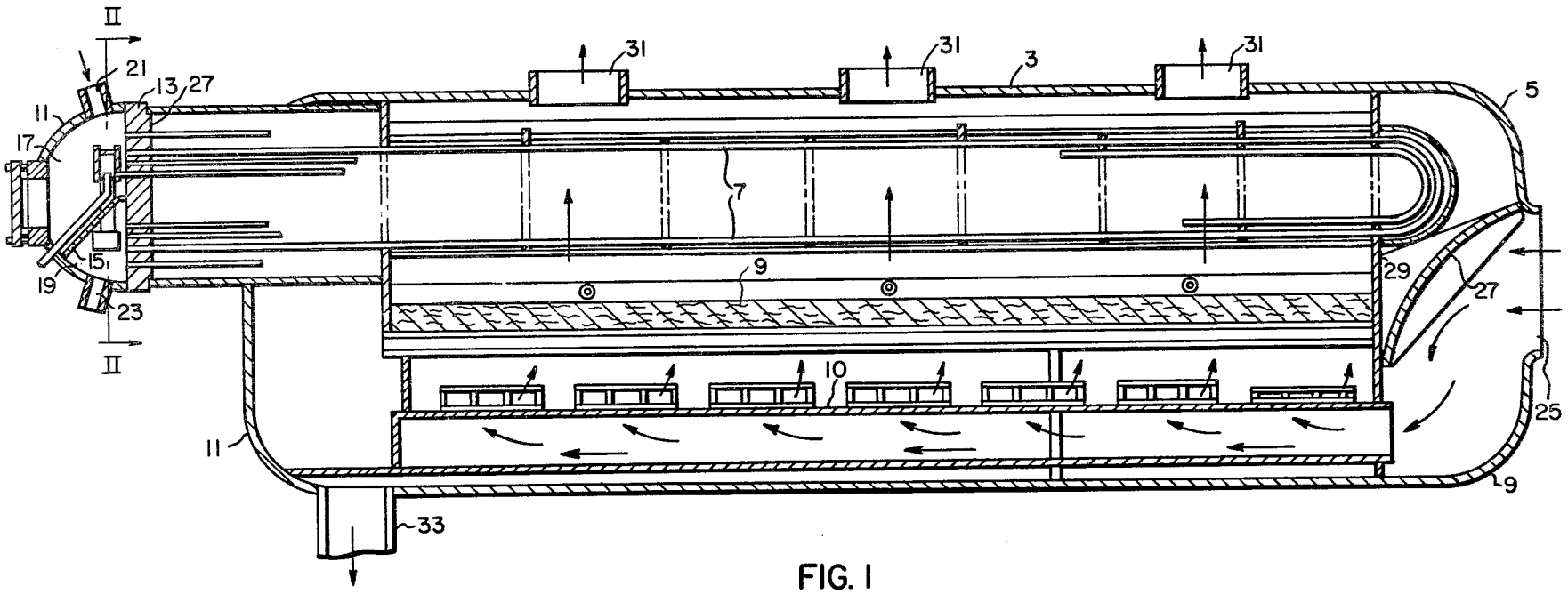
FIG. 1 is a sectional view of a moisture separator reheater incorporating a scavenging device made in accordance with this invention.

Referring now to the drawings in detail, there is shown a moisture separator reheater 1 for reheating steam which flows from a high pressure turbine to a lower pressure turbine (not shown) in a steam power plant.

The moisture separator reheater comprises an axially elongated shell 3, flanged and dished heads 5 and 6 enclosing each end of the shell 3 and a tube bundle formed from a plurality of U-shaped or U-tubes extending lengthwise across the upper portion of the shell 3.

A meshed pad or other moisture separating means 9 is disposed horizontally across the shell 3 adjacent the axis thereof and a distribution plate 10 is disposed horizontally in the shell below the moisture separating means 9.

A hemispherical head 11, tube sheet 13 and dividing plate 15 are cooperatively associated with the tube bundle in such a manner that the dividing plate 15 separates the hemispherical head 11 into inlet and outlet compartments or chambers 17 and 19, respectively.

A first fluid inlet nozzle 21 is disposed in fluid communication with the inlet chamber 17 to supply a first fluid, high temperature steam, to the inside of the tubes, wherein some of the steam is condensed. A first fluid outlet nozzle 23 is disposed in fluid communication with the outlet chamber 19 to drain condensed steam or condensate therefrom.

A second fluid inlet nozzle 25 is disposed in the head 5 and has baffles 27 and 29 cooperatively associated therewith to direct the second fluid, steam or vapor, to the distribution plate 10.

A plurality of second fluid outlet nozzles 31 are disposed in the upper portion of the shell 3 so that the second fluid flows through the distribution plates 10, the moisture separating means 9 and over the outer surface of the tubes 7 forming the tube bundle. A drain 33 is disposed in the shell to remove moisture separated from the second fluid by the moisture separating means 9.

Figure 3:
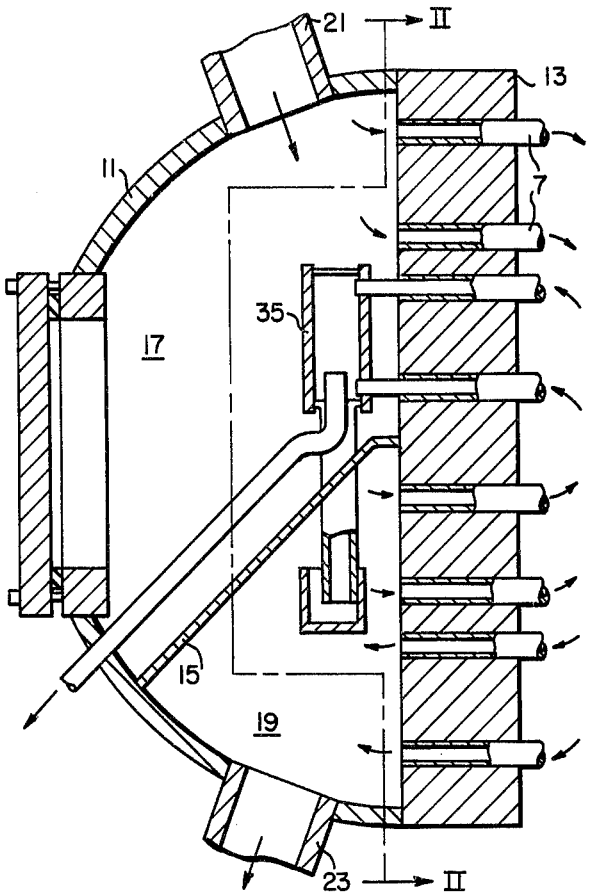
FIG. 3 is an enlarged sectional view taken on line III—III of FIG. 2.
Figure 4:
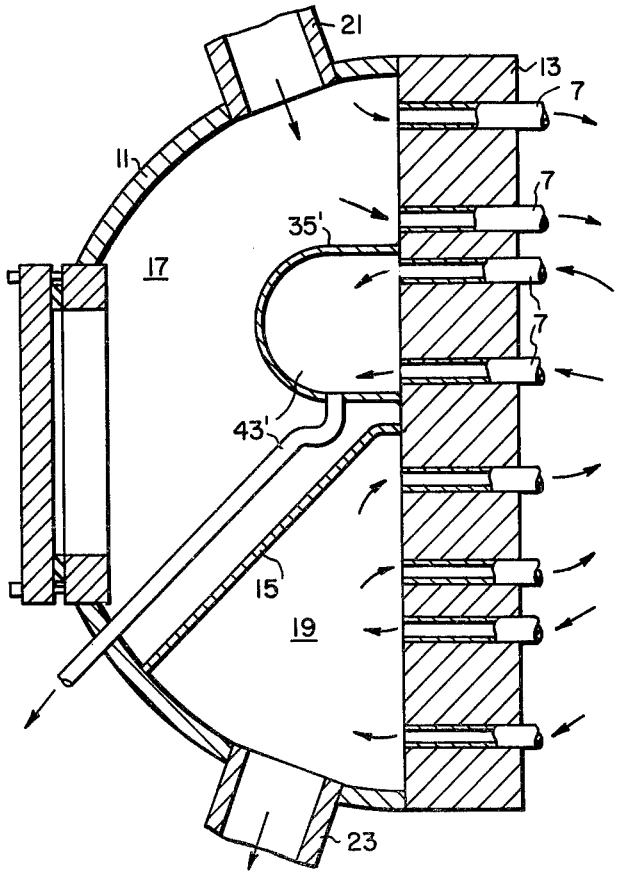
FIG. 4 is an enlarged sectional view of an alternate embodiment of this invention.

As best shown in FIGS. 3 and 4, the hemispherical head 11 has a header or manifold 35 and 35' respectively disposed in the inlet portion 17 so as to be in fluid communication with a plurality of tubes which have their ends disposed in the holes in the tube sheet 13. The mainfolds are disposed in communication with the tubes generally in the center of the tube bundle or with the tubes which have the smaller reversed bends in order to provide four passes of the first fluid through the second fluid. The first and second passes, respectively, are disposed to contact the effluent and influent secondary fluid.

FIG. 3 shows one embodiment in which the manifold 35 is a box-shaped vessel with generally parallel walls placed in fluid communication with the tubes 7 by a plurality of conduits or sleeves 37, which extend into the tubes and into the manifold. Drain pipes 39 depend from the manifold 35 and have seal cups 41 disposed on the lower end thereof to form a trap, which drains liquid or condensate from the manifold without allowing vapor or steam to escape. The drain pipes 39 extend through the dividing plate 15 so that the condensate flows into the outlet portion 19 of the head 11. There is a seal formed by welding or other means at the juncture of the drain pipe 39 and the dividing plate 15. A vent pipe 43 is disposed to extend through the hemispherical head 11 and into the manifold 35. The vent pipe 43 extends into the manifold 35 in such a manner that it will only vent steam or vapor from the manifold.

FIG. 4 shows another embodiment in which the manifold 35' is an elongated curved enclosure having both longitudinal margins fastened to the tube sheet by welding or other means and end plates so arranged to form at the enclosed manifold 35'. The vent pipe 43' is disposed to extend through the hemispherical head 11 and into the manifold 35' and is arranged to drain liquid as well as vent steam or vapor from the manifold making it unnecessary to penetrate the dividing plate 15.

The operation of the moisture separator reheater hereinbefore described is as follows: Steam or second fluid from a high pressure turbine flows through the second fluid inlet nozzle 25, through the distribution plate 10 and moisture separating means 9, wherein entrained moisture is removed from the second fluid. The moisture or condensate separated by the moisture separator flows to the lower portion of the shell by gravity and then out the drain nozzle 33. The second fluid then flows over the outside of the tubes 7 increasing its temperature and becomes superheated. The superheated steam or second fluid then flows to a lower pressure turbine via the outlet nozzles 31.

High pressure steam or first fluid enters the inlet nozzle 21 in the inlet portion 17 of the hemispherical head 11 and enters the tubes which are not in fluid communication with the manifolds 35 or 35'. Since the tubes are U-shaped, the high pressure and high temperature steam or first fluid flowing through the tubes makes two passes through the second fluid as the steam gives up its heat and flows from the inlet portion 17 to the outlet portion 19 of the hemispherical head 11. As the steam gives up its heat, some of it condenses, however, the flow in the tubes of the first and second pass is maintained at a velocity sufficiently high to prevent slugs of liquid from forming in the tubes. The condensate and steam then enters the outlet portion 19 of the hemispherical head 11 and due to the relatively large volume, the velocity of the mixture is decreased and the condensate is easily separated from the steam. The condensate flows by gravity to the first fluid outlet 23 and the steam flows through the tubes making up the third and fourth passes as the steam flows from the outlet portion 19 of the hemispherical head 11 to the manifold 35 or 35'. More than half, and generally in the range of 75%, of the steam is condensed in the first and second passes, whereby the outlet chamber 19 is effective to separate a large portion of the condensate from the steam.

Figure 2:
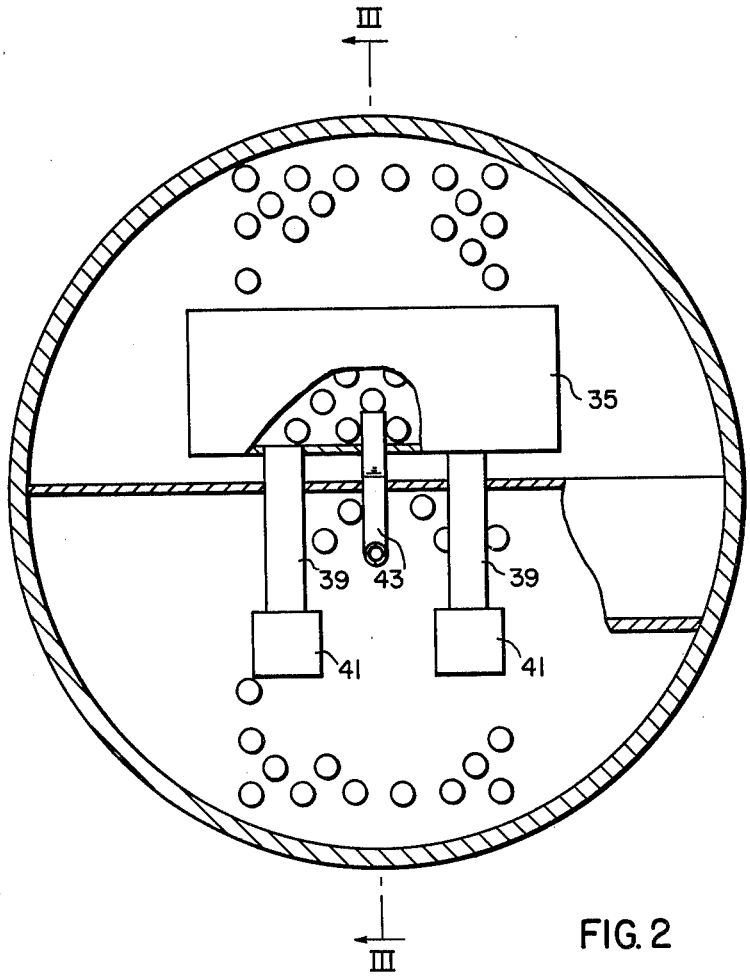
FIG. 2 is an elongated sectional view taken on line II—II of FIG. 1.

Additional condensate is formed in the third and fourth passes and this condensate may be separated from the vapor in the manifold 35 as shown in FIGS. 2 and 3. If this is the case, the condensate flows through the drain pipes 39 and collects in the cups 41 forming a vapor seal, overflows from the cup into the outlet portion 19 of the hemispherical head and then is drained via gravity through the outlet nozzle 23. Vapor, on the other hand, enters the vent pipe 43 and is vented to some lower pressure.

As shown in FIG. 4, the vent pipe 43' carries away both vapor and condensate to some lower pressure vessel. In either case a small amount of vapor is vented in order to scavenge condensate from the third and fourth passes.

The moisture separator reheater hereinbefore described advantageously arranges the passes so that the pass in which the majority of the condensate is formed, the one contacted by the influent second fluid, is disposed so that it immediately discharges into the outlet portion 19 of the head 11, wherein the condensate can be effectively separated from the steam before it enters the next pass. Performance calculations have indicated a marked improvement over designs herebefore utilized even though there will be an up-flow in the short radius U-bends between the third and fourth passes.

What is claimed is:

1. A heat exchanger for transferring heat from a first fluid, which changes state from a vapor to a liquid, to a second fluid, which increases in temperature, said heat exchanger comprising a shell, a tube sheet having a plurality of holes, a head cooperatively associated with said shell and tube sheet, a plurality of U-shaped tubes having their inlet and outlet ends disposed in said holes in said holes in said tube sheet, a dividing plate disposed in said head so as to produce a first chamber and a second chamber and to separate said inlet and outlet ends of all of said tubes, said second chamber being unobstructed allowing the fluid to flow freely therethrough, an inlet nozzle for said first fluid in fluid communication with said first chamber of said head, a manifold disposed within the first chamber of said head, said manifold being so disposed in fluid communication with a plurality of said tubes and to cooperate with said second chamber to cause said first fluid to make four passes through said second fluid, and in such a manner that the first two passes produce a countercurrent cross flow relationship and the last two passes produce a concurrent cross flow relationship with a general up flow in the bends of the U-shaped tubes of said last two passes, said second chamber of said head having a liquid drain nozzle disposed therein and said second chamber being disposed to form a large plenum chamber between said second and third passes, whereby liquid is separated from the first fluid prior to the first fluid entering said third pass, and a vent line in fluid communication with said mainfold, said vent line being disposed to vent vapor from said manifold.

2. A heat exchanger as set forth in claim 1 and further comprising a liquid drain in fluid communication with said manifold.

3. A heat exchanger as set forth in claim 2, wherein the liquid drain in fluid communication with said manifold has a liquid trap cooperatively associated therewith to prevent said drain from allowing vapor to pass therethrough.

4. A heat exchanger as set forth in claim 3, wherein the liquid drain in fluid communication with said manifold is also in fluid communication with said outlet portion of said head.

5. A heat exchanger as set forth in claim 1, wherein the manifold is so disposed that the outer surfaces of the tubes forming the first and second passes, respectively, are disposed in fluid communication with the effluent and influent second fluid.

6. A heat exchanger as set forth in claim 1, wherein the vent line is disposed to vent vapors and liquid.

* * * * *